US010781079B2

(12) United States Patent
Park et al.

(10) Patent No.: US 10,781,079 B2
(45) Date of Patent: Sep. 22, 2020

(54) SAFETY DEVICE FOR ESCALATOR

(71) Applicant: REPUBLIC OF KOREA (NATIONAL DISASTER MANAGEMENT RESEARCH INSTITUTE), Ulsan (KR)

(72) Inventors: Dugkeun Park, Ulsan (KR); Sujung Im, Gyeonggi-do (KR)

(73) Assignee: REPUBLIC OF KOREA (NATIONAL DISASTER MANAGEMENT RESEARCH INSTITUTE) (KR)

( * ) Notice: Subject to any disclaimer, the term of this patent is extended or adjusted under 35 U.S.C. 154(b) by 0 days.

(21) Appl. No.: 16/680,679

(22) Filed: Nov. 12, 2019

(65) Prior Publication Data

US 2020/0079624 A1 Mar. 12, 2020

Related U.S. Application Data

(63) Continuation of application No. PCT/KR2018/002059, filed on Feb. 20, 2018.

(30) Foreign Application Priority Data

Feb. 2, 2018 (KR) ..... 10-2018-0013481

(51) Int. Cl.
*B66B 29/08* (2006.01)
*B66B 29/06* (2006.01)

(52) U.S. Cl.
CPC ..... *B66B 29/08* (2013.01); *B66B 29/06* (2013.01)

(58) Field of Classification Search
CPC ..... B66B 29/00; B66B 31/00; B66B 29/08; B66B 29/06
See application file for complete search history.

(56) References Cited

U.S. PATENT DOCUMENTS 5,398,800 A * 3/1995 Hofling ..... B66B 29/06 198/323
5,611,417 A * 3/1997 Stawniak ..... B66B 29/06 198/323

(Continued)

FOREIGN PATENT DOCUMENTS

FR 2693446 A1 * 1/1994 ..... B66B 21/12
JP 04-201985 A 7/1992

(Continued)

OTHER PUBLICATIONS

International Search Report (PCT/KR2018/002059), WIPO, dated Oct. 31, 2018.

(Continued)

*Primary Examiner* — Mark A Deuble
(74) *Attorney, Agent, or Firm* — Park & Associates IP Law, P.C.

(57) ABSTRACT

The present invention relates to a safety device for an escalator, which can safely move a person or cart on a moving step of the escalator or a moving walkway toward a platform, the safety device comprising: a tilting member comprising a free end portion extended from a front end portion of a platform member, which covers an upper surface of a moving step getting thereunder in an end region of the escalator, toward an upper surface of an entering moving step, and a rotary end portion rotatably installed under the platform member; a contact roller installed in a region of the free end portion and rotatable being in contact with the moving step; and at least one guide roller rotatable being in contact with the contact roller and partially exposed through the upper surface.

7 Claims, 4 Drawing Sheets

(56) References Cited

U.S. PATENT DOCUMENTS

| | | | | |
|---|---|---|---|---|
| 5,971,129 | A | 10/1999 | Stawniak et al. | |
| 6,241,070 | B1 * | 6/2001 | Loder | B66B 29/06 198/323 |
| 6,644,457 | B2 * | 11/2003 | Lauch | B66B 29/06 198/322 |
| 2005/0016816 | A1 | 1/2005 | Diaz | |
| 2008/0029364 | A1 * | 2/2008 | Mustalahti | B66B 23/10 198/325 |

FOREIGN PATENT DOCUMENTS

| | | | |
|---|---|---|---|
| JP | 08-127487 | A | 5/1996 |
| JP | 09-286582 | A | 11/1997 |
| JP | 2014-118297 | A | 6/2014 |
| KR | 20-1999-0038383 | U | 10/1999 |
| KR | 10-2000-0054994 | A | 9/2000 |

OTHER PUBLICATIONS

Korean Office Action (KR 10-2018-0013481), KIPO, dated Mar. 26, 2019.

Korean Notice of Allowance (KR 10-2018-0013481), KIPO, dated Oct. 4, 2019.

* cited by examiner

SAFETY DEVICE FOR ESCALATOR

REFERENCE TO RELATED APPLICATIONS

This is a continuation of International Patent Application PCT/KR2018/002059 filed on Feb. 20, 2018, which designates the United States and claims priority of Korean Patent Application No. 10-2018-0013481 filed on Feb. 2, 2018, the entire contents of which are incorporated herein by reference.

FIELD OF THE INVENTION

The present invention relates to a safety device for an escalator.

BACKGROUND OF THE INVENTION

A moving step of an escalator continuously moves toward a platform and gets under the platform. In this case, when a person or cart on the moving step does not rapidly move toward the platform, an accident that the person or cart collides with another person or cart coming from behind occurs. Such an accident may lead to an almost big accident because the moving steps are continuously moving.

The occurrence of the accident has been inherent in a conventional escalator with insufficient safeguards against the accident, and the conventional escalator has caused large shopping malls to employ workers to pull the cart on the moving step toward the platform and the like inconvenience.

SUMMARY OF THE INVENTION

The present invention is to provide a safety device for an escalator, which can safely guide a person or cart on a moving step toward a platform.

An aspect of the disclosure is achieved by providing a safety device for an escalator with a platform member which covers an upper surface of a moving step getting thereunder in an end region of the escalator, the safety device including: a tilting member including a free end portion extended from a front end portion of the platform member toward an upper surface of an approaching moving step, and a rotary end portion rotatably installed under the platform member; a contact roller installed in a region of the free end portion and rotatable being in contact with the moving step; and at least one guide roller rotatable being in contact with the contact roller and partially exposed through the upper surface Here, a spring member may be installed in the rotary end portion and elastically biases the free end portion in a direction to be spaced apart from the moving step, thereby allowing the guide roller to rotate only when a person or a cart comes into contact with the front end portion of the tilting member, and enhancing durability of the safety device for the escalator.

Further, a balance weight may be installed on an opposite side of the free end portion, thereby improving reliability of the tilting member.

Also, a cam roller may be disposed between the contact roller and the rotary end portion, be rotatable being in contact with the moving step, have a non-circular cross-section, and periodically move up and down the tilting member, thereby making a person or cart positioned above the rotary end portion easily move toward the platform.

Further, the guide roller may include a protrusion radially protruding therefrom, thereby making the guide roller more stably move a person or a cart toward the platform.

According to the present invention, a safety device for an escalator has an effect on safely guiding a person or cart on a moving step toward a platform.

Figure 1:
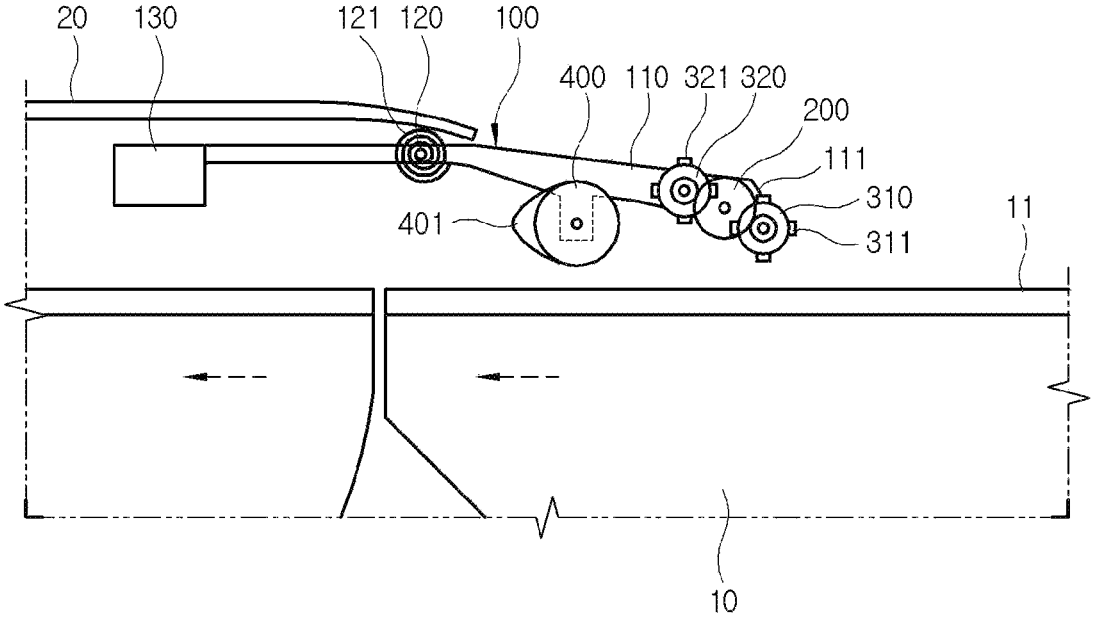
FIG. 1 illustrates a standby mode of a safety device for an escalator.

| <Reference Numerals for Major Elements in Drawings> | |
|---|---|
| 10: moving step | 11: groove |
| 20: platform member | 30: cart |
| 100: tilting member | 110: free end portion |
| 111: inclined portion | 120: rotary end portion |
| 121: spring member | 130: balance weight |
| 200: contact roller | 310: first guide roller |
| 320: second guide roller | 311, 321: protrusion |
| 400: cam roller | 401: cam portion |
| 500: power transmission unit | |

DETAILED DESCRIPTION OF THE INVENTION

Below, a safety device for an escalator according to the present invention will be described in more detail with reference to the accompanying drawings.

The safety device for the escalator according to the present invention is applicable to a type of machine in which a moving step 10 gets under a platform. In other words, the safety device for the escalator according to the present invention is applicable to an escalator, a moving sidewalk and the like automatic conveying mechanism. In this disclosure, for convenience of description, a person or a cart 30 is described by way of example, but the safety device for the escalator according to the present invention is applicable for safety of any object that moves from the moving step 10 toward the platform through the moving step 10 in the automatic conveying mechanism. Further, the person or the cart 30 disclosed in the present invention more specifically refers to the foot of the person or the wheel of the cart 30.

Figure 2:
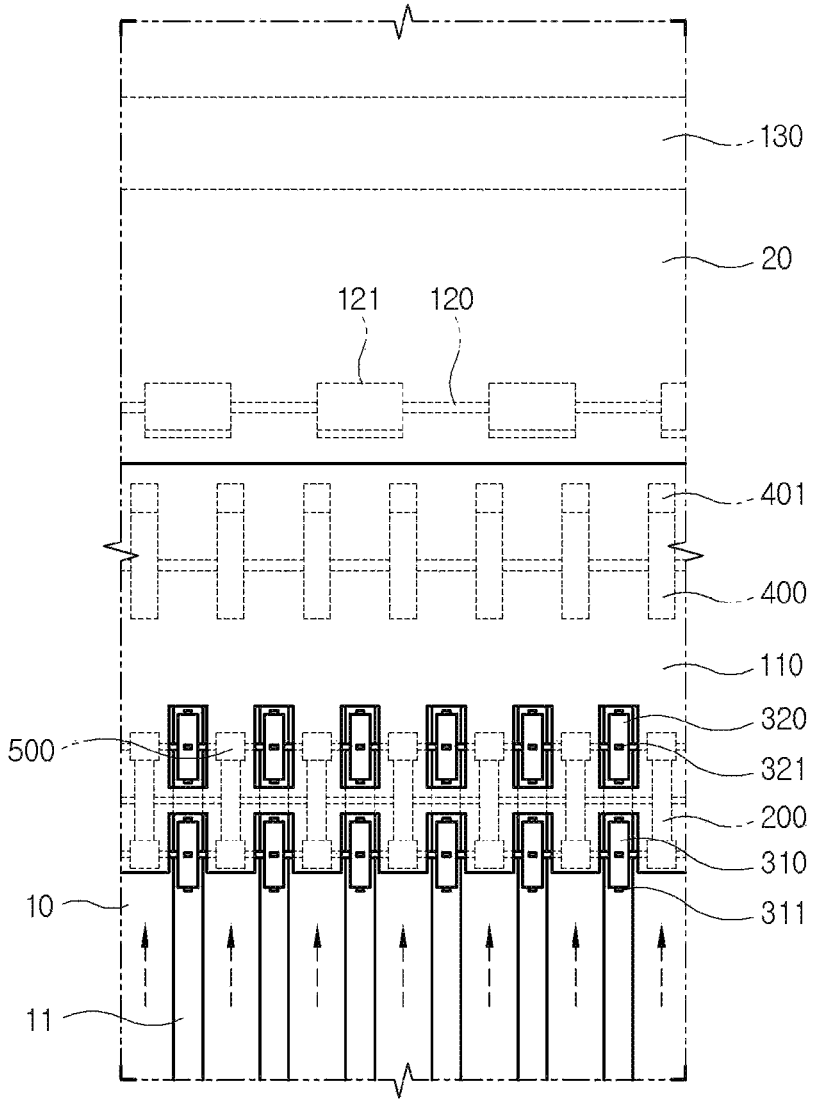
FIG. 2 is a plan view of the safety device for the escalator.
Figure 3:
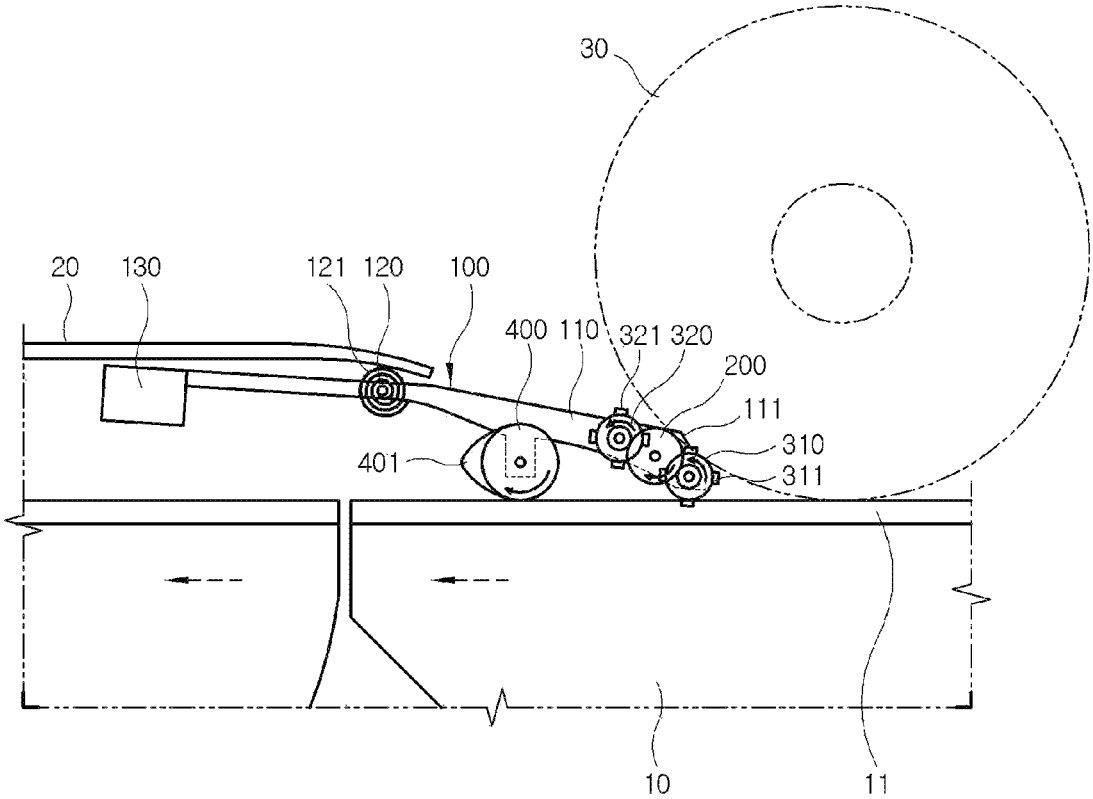
FIG. 3 illustrates an operation mode of the safety device for the escalator.
Figure 4:
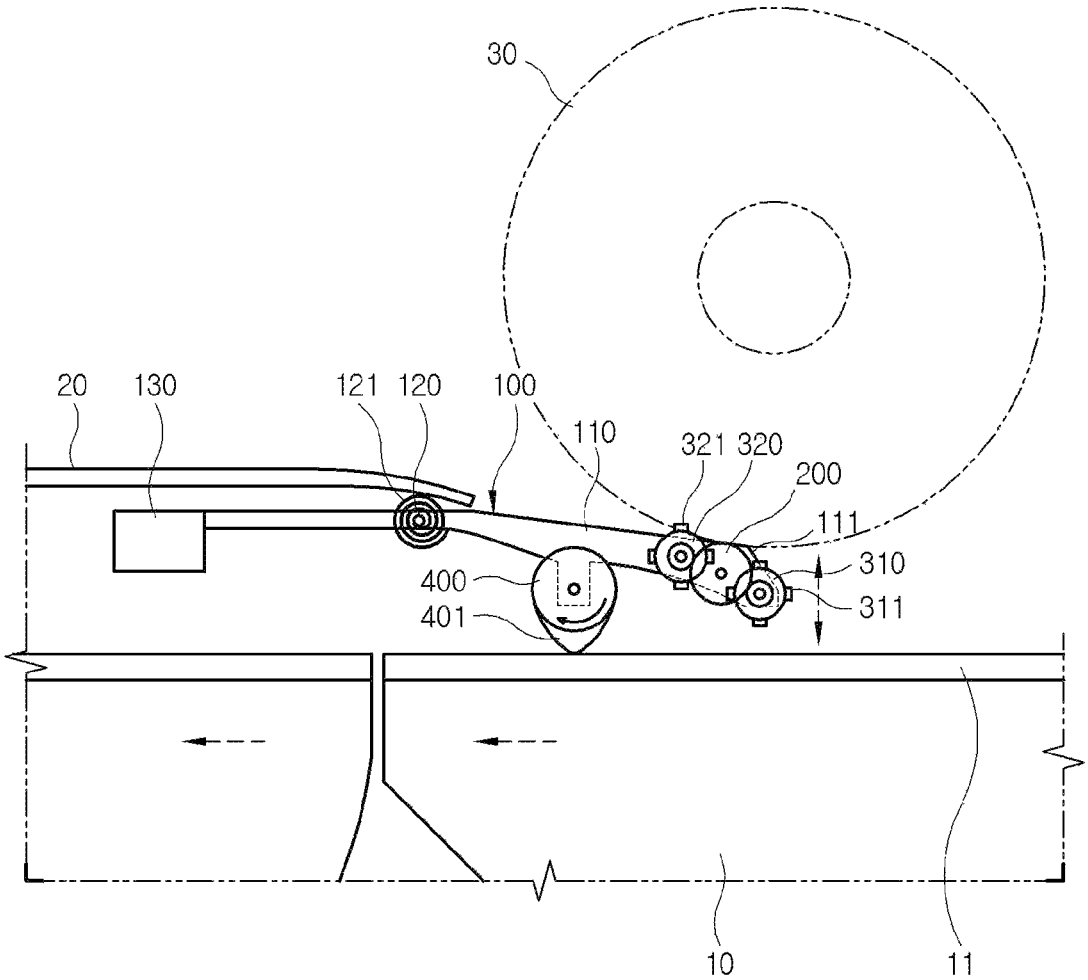
FIG. 4 illustrates a tilting mode of the safety device for the escalator.

FIG. 1 illustrates a standby mode of a safety device for an escalator, FIG. 2 is a plan view of the safety device for the escalator, FIG. 3 illustrates an operation mode of the safety device for the escalator, and FIG. 4 illustrates a tilting mode of the safety device for the escalator. Referring to FIGS. 1 to 4, the safety device for the escalator according to the present invention is installed in a platform member 20 covering an upper surface of the moving step 10 getting under an end region of an escalator, and includes a tilting member 100 having a free end portion 110 extended from the platform member 20 toward the upper surface of the moving step 10 and a rotary end portion 120 rotatably coupled to a lower portion of the platform member 20, a contact roller 200 installed in a region of the free end portion 110, and a guide roller.

The platform member 20 is a generic term for a member installed at a point where the platform meets the moving step 10 in the platform in which an object on the moving step 10 stays after getting out of the moving step 10. The safety device for the escalator according to the present invention is installed in the platform member 20 at an exit side where the moving step 10 gets under the platform, and the platform member 20 is also called a comb plate in a general industry site. The safety device for the escalator according to the present invention may be installed in such a comb plate.

The moving step 10 refers to a solid structure for automatically moving an object from one platform to the other platform of the escalator, as a part of the escalator or the moving walkway. The moving step 10 continuously moves from one platform to the other platform in the form of a plurality of foot-steps connected to each other forming a loop. The plurality of moving steps 10 are moved engaging with each other, and the moving step 10 includes grooves 11 recessed in the same direction as the moving direction and formed at regular intervals along a widthwise direction to make the moving steps 10 more precisely engage with each other and prevent an object from slipping over on the moving step 10.

The tilting member 100 is installed under the platform member 20, and includes the free end portion 110 extended from below the platform member 20 toward above the moving step 10, and the rotary end portion 120 rotatably coupled to the lower portion of the platform member 20

The free end portion 110 is shaped inclining downward in a direction from the rotary end portion 120 toward the moving step 10, or includes an inclined portion 111 formed at least inclining downward at an extended end region. The inclined portion 111 is to make an object on the moving step 10 more easily move above the free end portion 110 through the inclined portion 111 when the object comes into contact with the front end region of the free end portion 110 as the moving step 10 moves, so that the object on the moving step 10 can move above the free end portion 110 after contacting the front end of the free end portion 110 when the moving step 10 (to be described later) gets under the free end portion 110 due to such a shape of the free end portion 110

The rotary end portion 120 is installed under the platform member 20, and the tilting member 100 is tiltable within a predetermined angle under the platform member 20 by coupling between a pin hole formed in one of the rotary end portion 120 and the platform member 20 and a rotary pin formed in the other one. Such a tiltable angle of the tilting member 100 is between a standby position where the end of the platform member 20 is in contact with the upper end of the tilting member 100 and an operation position where the bottom surface of the tilting member 100 is in contact with the top surface of the moving step 10. Due to the tiltable angle, the end of the free end portion 110 is movable up and down as much as the tiltable angle.

The rotary end portion 120 is provided with a spring member 121 to maintain the tilting member 100 in the standby position. The spring member 121 applies elasticity to make the free end portion 110 be maintained in the standby position. The spring member 121 is provided as a rolled-up flat spring installed in the rotary pin and wound along the rotary pin, and has an end being in contact with a lower portion of the free end portion 110 and continuously pushing the free end portion 110 upward.

With this configuration, the free end portion 110 is movable between the standby position and the operation position, and maintained in the standby position by the spring member 121. Therefore, when an object on the moving step 10 moves along the moving step 10 and comes into contact with the front end region of the free end portion 110 or pushes down the upper surface of the free end portion 110, the moving step 10 downwardly moves with respect to the operation position due to the shape of the free end portion 110 or the inclined portion 111. When such contact or action of the object disappears, the free end portion 110 returns to and is maintained in the standby position.

Like this, the free end portion 110 tilting and moving between the standby position and the operation position includes the contact roller 200 rotatable being in contact with the moving step 10, and at least one guide roller rotatable by the contact of the contact roller 200 and having an upper surface partially exposed to the upper surface of the tilting member 100.

The contact roller 200 is installed not to be exposed to the upper surface of the tilting member 100. The contact roller 200 does not rotate in the standby mode, but rotates in an opposite direction to the moving direction of the moving step 10 while being in contact with the moving step 10 only in the operation mode. That is, the contact roller 200 rotates interworking with the moving step 10 by a force of moving the moving step 10, and has a material or shape for friction high enough to convert the force of moving the moving step 10 into a rotational force when the contact roller 200 comes into contact with the moving step 10.

The guide roller is formed to rotate by the rotation of the contact roller 200. Because the contact roller 200 rotates in the opposite direction to the moving step 10 and the guide roller rotates by the rotation of the contact roller 200, the guide roller rotates in the same direction as the moving step 10. That is, the guide roller rotates in a direction that the moving step 10 gets under the platform member 20. With the rotation of the guide roller, an object that comes into contact with the free end portion 110 moves toward the platform.

The guide roller is partially exposed through an upper surface or front end surface of the tilting member 100, and therefore an object comes into contact with the exposed surface of the guide roller and moves in the rotating direction of the guide roller.

A plurality of guide rollers may be installed in the moving direction of the moving step 10. In the drawings, a first guide roller 310 and the second guide roller 320 are provided. The first guide roller 310 is installed in the front end region of the free end portion 110 as it is partially inserted in the groove 11, and the second guide roller 320 is installed as it is spaced apart at a predetermined distance from the first guide roller 310.

The first guide roller 310 is installed in the front end region of the free end portion 110 and comes into direct contact with an object on the moving step 10 when the object does not move to the platform at an appropriate time, thereby moving the object above the free end portion 110. The first guide roller 310 may be formed to be partially inserted in the groove 11 of the moving step 10 in the operation mode, thereby preventing foreign materials from being caught in a space caused by the groove 11. The second guide roller 320 makes an object moved by the first guide roller 310 or an object being in contact with the upper portion of the second guide roller 320 be pushed toward the platform. As necessary, a plurality of guide rollers may be arranged at proper intervals.

FIG. 2 illustrates a power transmission unit 500 for transmitting a rotational force of the contact roller 200 to the guide rollers. The power transmission unit 500 has the same axis as the rotational axis of the guide roller, and rotates in the opposite direction to the contact roller 200 while being in contact with the end of the contact roller 200. Such a rotating direction of the power transmission unit 500 is the same as that of the guide roller. Although it is illustrated that the power transmission unit 500 is configured with a roller and a shaft, the configuration of the power transmission unit 500 is selectable among configurations for transmitting the rotational force of the contact roller 200 to the guide roller so that the guide roller can rotate in the opposite direction to the contact roller 200.

The safety device for the escalator according to the present invention may include a cam roller 400 disposed between the contact roller 200 and the rotary end portion 120, rotatable being in contact with the moving step 10, having a non-circular cross-section, and periodically moving the tilting member 100 up and down.

The cam roller 400 is installed not to be exposed through the upper surface of the tilting member 100, and has a cam portion 401 formed as a partial outer side of a circular roller radially protrudes. The cam roller 400 is installed at a position so that its portion where the cam portion 401 is not formed can be rotated by the moving step 10 while being in contact with the moving step 10 when the contact roller 200 comes into contact with the moving step 10. That is, when a person, a cart 30 or the like object comes into contact with the front end or upper surface of the free end portion 110, the free end portion 110 moves down and at this time the contact roller 200 rotates being in contact with the moving step 10. At this time, the portion of the cam roller 400, in which the cam portion 401 is not formed, also comes into contact with the moving step 10. When the cam portion 401 of the cam roller 400 first comes into contact with the moving step 10 by the contact with the object, the contact roller 200 is not in contact with the moving step 10. When the portion where the cam portion 401 is not formed comes into contact with the moving step 10 as the cam portion 401 of the cam roller 400 is rotated by the moving step 10, the free end portion 110 moves down as much as the protruding height of the cam portion 401, thereby making the contact roller 200 be in contact with the moving step 10.

Due to the cam roller 400, the free end portion 110 periodically moves up and down and enters the tilting mode, thereby having an effect on easily lifting up an object on the front end or upper surface of the free end portion 110 toward the platform.

With the foregoing configurations, the safety device for the escalator operates as follows.

In the standby mode, the free end portion 110 stands by being spaced apart from the moving step 10 by the spring member 121. In this case, the contact roller 200 is spaced apart from the moving step 10. FIG. 1 illustrates the standby mode.

When a person or the cart 30 is moved by the moving step 10 and approaches the platform member 20, the front end region of the person or the cart 30 comes into contact with the front end or upper surface of the free end portion 110, and thus the free end portion 110 moves down to make the contact roller 200 and the cam roller 400 be in contact with the moving step 10 and switch over to the operation mode. In this case, when the free end portion 110 moves down with the cam portion 401 of the cam roller 400 facing downward, the cam portion 401 first comes into contact with the moving step 10 and therefore the contact roller 200 does not rotate. When the cam portion 401 rotates and then the portion where the cam portion 401 is not formed comes into contact with the moving step 10, the contact roller 200 also comes into contact with the moving step 10. This operation mode is illustrated in FIG. 3.

The contact roller 200 rotates in the opposite direction to the moving step 10, and this rotation makes the guide rollers rotate in the moving direction of the moving step 10, i.e., rotate in a direction from the moving step 10 toward the platform. Because the guide roller is partially exposed through the upper surface of the tilting member 100, the person or the cart 30 is moved toward to the platform by the guide roller.

While the person or the cart 30 is moving, the cam roller 400 rotates and thus the cam portion 401 comes into contact with the moving step 10 again, thereby entering the tilting mode. Thus, the free end portion 110 of the tilting member 100 moves up. Such a tilting operation makes the person or the cart 30 more easily move toward the platform. That is, the person or the cart 30 is lifted up and pushed toward the platform by the tilting operation of the cam roller 400 and the moving step 10 even though the person or the cart 30 is heavy. This tilting mode is illustrated in FIG. 4.

When the person or the cart 30 gets out of the free end portion 110, the contact roller 200 or the cam roller 400 is separated from the moving step 10 and switches over again to the standby mode.

In other words, when the person or the cart 30 comes into contact with the free end portion 110 under the standby mode, the contact roller 200 or the cam roller 400 alternates between the operation mode and the tilting mode. When the person gets out of the free end portion 110, the contact roller 200 or the cam roller 400 returns to the standby mode. By repetitive tilting operations, the object is easily lifted up from the moving step 10 and moved toward the platform while being more stably guided by the guide rollers.

Next, another embodiment of the safety device for the escalator according to the present invention will be described.

The tilting member 100 of the safety device for the escalator according to the present invention may include a balance weight 130 installed on the opposite side of the free end portion 110. To make the free end portion 110 of the tilting member 100 reliably switch over between the standby mode and the operation mode or the tilting mode, the free end portion 110 needs to be always maintained in the standby mode by an elastic member. When the elasticity of the elastic member becomes weaker, the free end portion 110 may move down and make the contact roller 200 or the cam roller 400 be in continuous contact with the moving step 10, thereby making noise or causing unnecessary wear. The balance weight 130 is formed to be heavier than the free end portion 110 on the opposite side of the free end portion 110, so that the free end portion 110 can be stably maintained in the standby mode. Therefore, even though the elastic member is not properly working, the free end portion 110 can reliably switch over between the standby mode, the operation mode and the tilting mode.

The guide roller of the safety device for the escalator according to the present invention may include protrusions 311 and 321 protruding in a radial direction. The guide roller rotates in the opposite direction to the rotating direction of the contact roller 200 while being in contact with the contact roller 200, thereby moving an object on the free end portion 110 toward the platform. The protrusions 311 and 321 radially protruding from the guide roller have an effect on increasing friction with an object or directly pushing the object.

The present invention is applicable to a safety device for an escalator.

What is claimed is:

1. A safety device for an object conveying system with a platform member which covers an upper surface of a moving step adapted to pass under the platform in an end region of the object conveying system, the safety device comprising:

a tilting member comprising a free end portion extended from under a front end portion of the platform member toward an upper surface of an approaching moving step, and a rotary end portion rotatably installed under the platform member;

a contact roller installed in a region of the free end portion;

at least one guide roller rotatably coupled to the contact roller and partially exposed through an upper surface of the tilting member; and a cam roller disposed between the contact roller and the rotary end portion, the cam roller being rotatable and being in contact with the moving step when the tilting member is in an operating position, and configured to periodically move the tilting member up and down.

2. The safety device for the object conveying system according to claim 1, further comprising a spring member installed in the rotary end portion and elastically biasing the free end portion in a direction to be spaced apart from the moving step.

3. The safety device for the object conveying system according to claim 1, further comprising a balance weight installed on an opposite side of the free end portion.

4. The safety device for the object conveying system according to claim 1, wherein the guide roller comprises a protrusion radially protruding therefrom.

5. The safety device for the object conveying system according to claim 1, wherein the tilting member is movable between a standby position where the contact roller installed to the free end portion is stationary as the contact roller is spaced apart from the upper surface of the approaching moving step, and the operating position where the contact roller installed to the free end portion is tilted downwards and is rotatable by frictional force as the contact roller is in contact with the approaching moving step, and wherein the rotation of the contact roller causes rotation of the at least one guide roller rotatably coupled thereto, which in turn facilitates moving a conveying object on the moving step by rotation of the at least one guide roller.

6. The safety device for the object conveying system according to claim 1, wherein the object conveying system is an escalator.

7. The safety device for the object conveying system according to claim 1, wherein the object conveying system is a movable sidewalk or an automatic conveying system.

* * * * *